US011932465B2

(12) United States Patent
Joines et al.

(10) Patent No.: US 11,932,465 B2
(45) Date of Patent: Mar. 19, 2024

(54) CARTON

(71) Applicant: MM NEWPORT LTD., Bradford (GB)

(72) Inventors: Mark David Joines, Cheltenham (GB); Steven Gerard Archambault, Pemberton, NJ (US)

(73) Assignee: MM NEWPORT LTD., Bradford (GB)

( * ) Notice: Subject to any disclaimer, the term of this patent is extended or adjusted under 35 U.S.C. 154(b) by 0 days.

(21) Appl. No.: 17/609,961

(22) PCT Filed: May 7, 2020

(86) PCT No.: PCT/EP2020/062686
§ 371 (c)(1),
(2) Date: Nov. 9, 2021

(87) PCT Pub. No.: WO2020/225355
PCT Pub. Date: Nov. 12, 2020

(65) Prior Publication Data

US 2022/0204210 A1 Jun. 30, 2022

(30) Foreign Application Priority Data

May 9, 2019 (GB) ..... 1906536

(51) Int. Cl.
*B65D 83/04* (2006.01)
*B65D 5/38* (2006.01)
(Continued)

(52) U.S. Cl.
CPC ..... *B65D 5/38* (2013.01); *B65D 50/046* (2013.01); *B65D 75/36* (2013.01);
(Continued)

(58) Field of Classification Search
CPC ..... B65D 5/38; B65D 50/046; B65D 75/36; B65D 83/0463
(Continued)

(56) References Cited

U.S. PATENT DOCUMENTS 6,491,211 B1 12/2002 Evans et al.
9,326,913 B2 * 5/2016 Weston ..... B65D 77/0413
(Continued)

FOREIGN PATENT DOCUMENTS

WO 2009/024772 A2 2/2009
WO 2011/154822 A1 12/2011
(Continued)

OTHER PUBLICATIONS

United Kingdom Search Report issued in corresponding United Kingdom Application No. GB1906536.6, dated Oct. 8, 2019 (6 pages).
(Continued)

*Primary Examiner* — Luan K Bui
(74) *Attorney, Agent, or Firm* — FLYNN THIEL, P.C.

(57) ABSTRACT

A carton with a housing including an outer layer and an inner layer and a sliding container enclosable within the inner layer of the housing. The sliding container can be moved from a closed configuration wherein the sliding container is enclosed within the inner layer to an open configuration wherein at least a portion of the sliding container is outside the housing. The sliding container comprises an engagement means engagable with an aperture in the housing inner layer when in register with the aperture to hold the sliding container in the closed configuration. The outer layer of the housing comprises means for applying pressure in register with the aperture such that pressure applied in register with the aperture is exerted on the engagement means to thereby disengage the engagement means from the aperture to allow the sliding container to move from the closed to the open configuration.

16 Claims, 9 Drawing Sheets

(51) Int. Cl.
*B65D 50/04* (2006.01)
*B65D 75/36* (2006.01)
*B65D 85/10* (2006.01)

(52) U.S. Cl.
CPC ..... *B65D 83/0463* (2013.01); *B65D 2215/02* (2013.01); *B65D 2401/00* (2020.05)

(58) Field of Classification Search
USPC ..... 206/1.5, 265, 267, 268, 270, 468, 538, 206/539, 804, 807; 229/125.125
See application file for complete search history.

(56) References Cited

U.S. PATENT DOCUMENTS

| | | | | |
|---|---|---|---|---|
| 2006/0131205 | A1 | 6/2006 | Sandberg et al. | |
| 2010/0084308 | A1* | 4/2010 | Rigby | B65D 83/0463 229/122 |
| 2011/0036743 | A1 | 2/2011 | Wharton | |
| 2013/0140201 | A1* | 6/2013 | Ghini | B65D 85/1036 206/267 |
| 2016/0001937 | A1 | 1/2016 | Skinner | |
| 2016/0251107 | A1* | 9/2016 | Everett | B65D 59/04 206/1.5 |
| 2017/0297803 | A1* | 10/2017 | Chambers | B65D 5/38 |
| 2018/0072452 | A1 | 3/2018 | Chambers | |

FOREIGN PATENT DOCUMENTS

| | | | |
|---|---|---|---|
| WO | 2013/151806 | A1 | 10/2013 |
| WO | 2013/164372 | A1 | 11/2013 |
| WO | 2015/066109 | A1 | 5/2015 |

OTHER PUBLICATIONS

International Search Report issued in corresponding International Application No. PCT/EP2020/062686, dated Oct. 9, 2020 (7 pages).
Written Opinion of the International Searching Authority issued in corresponding International Application No. PCT/EP2020/062686, dated Oct. 9, 2020 (8 pages).

* cited by examiner

CARTON

The present invention relates to child resistant packaging which may be used to hold harmful products such as toxic substances, pharmaceutical products, smoking articles, sharp objects and the like.

Packaging, for example cartons, are used to hold a number of different products. A carton is a container such as a box typically formed from card, paperboard, laminated board, polymer sheet or other similar materials. Cartons are frequently used to hold products such as pharmaceutical products, smoking articles, veterinary products, cleaning products, water treatment products, plant protection products, sharp objects, small components, harmful substances and the like.

Pharmaceutical products are frequently contained within blister packs which include a foil barrier that acts to protect the pharmaceutical product from moisture, light and other external perturbations, while also providing a degree of child resistance. Blister packs are often contained within a carton, such as a cuboidal box formed from card, which is closed at one or both ends with a tuck in flap. Such boxes are often not child resistant. In other words, a child can easily remove the tuck in flap and access the contents, such as a blister pack, within the box. Accidental consumption of pharmaceutical products by children remains a significant problem in many countries.

While child resistant caps for bottles, such as medicine bottles, and child resistant blister foils exist, there is a need for cartons to include a child resistant element to help prevent a child from accessing the contents of the carton and unintentionally causing harm. At the same time, the carton may need to be accessed by the elderly and seriously ill, who may have limited strength, dexterity, and diminished motor skills due to age or illness. Thus, there is a need for a carton that cannot be accessed by a child, but is openable by an adult.

Smoking articles, such as conventional tobacco cigarettes and more recently marijuana smoking articles (e.g. "joints") are frequently contained within a carton, such as a rectangular box formed from card. Such boxes are often not child resistant meaning the child can access the smoking articles inside. This is particularly problematic given the increased availability and use of marijuana smoking articles in many countries. Thus, there is a need for a carton for smoking articles that cannot be accessed by a child, but is still openable by an adult.

Conventional child resistant packages are made from more than one material, resulting in a relatively complicated and lengthy manufacturing procedure causing an increase in the cost of manufacturing. The use of more than one material may also create lines of weakness in the child resistant packaging. Consequently, there is a need for a child resistant packaging made from a single material.

According to the present invention there is provided a (e.g. child resistant) carton comprising; a housing comprising an outer layer and an inner layer; and a sliding container dimensioned such that it may be enclosed within the inner layer of the housing; wherein the sliding container can be moved from a closed configuration wherein the sliding container is enclosed within the inner layer of the housing to an open configuration wherein at least a portion of the sliding container is outside the housing; characterised in that; the sliding container comprises an (e.g. substantially wing shaped) engagement means (e.g. a tab) which engages with an aperture (e.g. hole) in the housing inner layer when in register with the aperture (e.g. hole) to thereby hold the sliding container in the first closed configuration; and the outer layer of the housing comprising a means for applying pressure (e.g. pressing tab) in register with the aperture (e.g. hole) of the inner layer, such that pressure applied in register with the aperture (e.g. hole) of the inner layer is exerted on the (e.g. substantially wing shaped) engagement means (e.g. tab) to thereby disengage the (e.g. substantially wing shaped) engagement means (e.g. tab) from the aperture (e.g. hole) to allow the sliding container to move from the closed configuration to the open configuration.

The carton may be a foldable carton. The carton may be child resistant.

It will be appreciated that the sliding container may also be considered a housing. For example, a housing for a blister pack or a housing for smoking articles.

The applicants have found that a carton that includes both a means for applying pressure in register with an aperture and an engagement means engageable with the aperture provides a simple and effective means for providing a child resistant carton. The user must compress the means for applying pressure on the housing while simultaneously pulling the sliding container to open the carton, which may be difficult for a child to achieve due to the finger strength and dexterity required and the complexity of the action. While a child may be prevented from opening the carton, it is possible for an adult to open the carton. Additionally, the carton is not configured to be so difficult to open that an elderly person or adult with reduced motor skills, strength or coordination cannot open the carton.

Preferably the means for applying pressure is a pressing tab. Preferably the engagement means is a tab. Preferably the housing comprises an open end and a closed end, wherein the sliding container extends from the open end when in the open configuration. It will be appreciated that the open end is the end of the housing through which the sliding container moves when the carton is in use. It will be appreciated that the closed end of the housing is located on the opposite side of the housing with respect to the open end.

Preferably the housing and sliding container are formed from the same material. Preferably the housing inner layer and outer layer are formed from the same continuous sheet of material. The applicants have found that by using a single material to produce a carton according to the present invention, they are able to both simplify the manufacturing procedure and provide a packaging that is more capable of resisting being opened by a child.

Preferably the means for applying pressure (e.g. pressing tab) is formed from the same continuous sheet of material as the housing. Preferably the engagement means (e.g. tab) is form from the same continuous sheet of material as the sliding container. Preferably the material used is an anti-tear laminate. By forming the means for apply pressure and/or engagement means from the same material as that used to make the carton the applicants have been able to simplify the manufacturing procedure and reduce the number of materials required to produce the carton in comparison to more conventional child resistant packaging. Preferably the sliding container comprises first and second (e.g. substantially wing shaped) engagement means (e.g. tabs) located on (e.g. respectively) opposite sides of the sliding container which engage with first and second (e.g. rear) apertures (e.g. holes) on (e.g. respectively) opposite sides of the housing inner layer when in register with the first and second (e.g. rear) apertures (e.g. holes); and the outer layer of the housing comprises first and second (e.g. rear) means for applying pressure (e.g. pressing tabs) in register with the first and second (e.g. substantially wing shaped) engagement means (e.g. tabs) to thereby disengage the first and second (e.g. substantially wing shaped) engagement means (e.g. tabs) from the first and second (e.g. rear) apertures (e.g. holes) to allow the sliding container to move from the closed configuration to the open configuration; wherein the first and second (e.g. rear) means for applying pressure (e.g. pressing tabs) are located on (e.g. respectively) opposite sides of the housing. Preferably the first and second apertures (and their respective means for applying pressure) are located toward the rear of the housing. The rear first and second apertures allow for the sliding container to be held in the closed configuration. It will be appreciated that the rear of the housing is the region of the housing located toward the closed end of the housing.

It will be appreciated that the positioning of features of the invention "on opposite sides" to one another can be taken to mean that the features (e.g. engagement means/apertures/means for applying pressure) are on opposite sides with respect to one another (i.e. on respectively opposite sides). For example, when a first and second engagement means are located on opposite sides of the sliding container, the first engagement means is positioned on the opposite side of the sliding container with respect to the second engagement means. This is illustrated in the attached Examples and Figures. FIG. 4 indicates a first and second engagement means located on opposite sides of the sliding container. FIGS. 1 and 2 indicate first and second (and third and fourth) apertures positioned on opposite sides of the housing inner layer.

Preferably the sliding container comprises a pull tab located towards the open end of the housing. Preferably the pull tab is positioned on the front side of the sliding container. The pull tab allows for the adult user (particularly the more senior adult user) to easily move the sliding container from the closed configuration to the open configuration when the means for applying pressure are compressed. The pull tab also increases the level of dexterity required to open the carton to prevent opening of the package by a child.

When the carton includes a first and second means for applying pressure in register with a first and second aperture and a first and second engagement means, the user must compress both the first and second means for applying pressure while simultaneously pulling the sliding container to open the carton. The applicants have found that having both the means for applying pressure in register with an aperture and the engagement means engageable with the aperture positioned on respectively opposite sides of the carton helps to provide a secure lock to thereby prevent opening of the packaging by a child. This configuration may also mean that the means for applying pressure are spaced such that a child cannot simultaneously compress both the means for applying pressure to thereby open the carton because the child would not have a sufficiently large finger span or hand span to do so. For example, the distance between each means for applying pressure may be greater than the fingerspan of a child, but smaller than the finger span of an adult. For example, the distance between the apertures may be greater than the fingerspan of a child, but smaller than the finger span of an adult. For example, the distance between the engagement means may be greater than the fingerspan of a child, but smaller than the finger span of an adult. For example, the distance between each means for applying pressure/apertures/engagement means may be greater than the distance between a child's thumb and little finger, thumb and ring finger, thumb and middle finger, or thumb and index finger, such that the child cannot simultaneous compress each means for applying pressure using one hand. For example, the distance between each means for applying pressure may be between about 50 mm and 150 mm, for example between about 50 mm and 80 mm, for example between about 60 mm and 70 mm, for example between 60 and 90 mm, for example between about 70 and 80 mm. For example, the distance between each aperture may be between about 50 mm and 150 mm, for example between about 50 mm and 80 mm, for example between about 60 mm and 70 mm, for example between 60 and 90 mm, for example between about 70 and 80 mm. For example, the distance between each engagement means may be between about 50 mm and 150 mm, for example between about 40 mm and 80 mm, for example between about 50 mm and 60 mm, for example between 60 and 90 mm, for example between about 60 and 70 mm.

Preferably the inner layer of the housing comprises third and fourth (e.g. front) apertures located on opposite sides of the inner housing such that the first and second (e.g. substantially wing shaped) engagement means (e.g. tabs) engage with the first and second (e.g. front) apertures in the housing inner layer when in register with the first and second (e.g. front) apertures to thereby hold the sliding container in the closed configuration; and wherein, when the sliding container is moved from the closed configuration to the open configuration, the first and second (e.g. substantially wing shaped) engagement means (e.g. tabs) engage with the third and fourth (e.g. front) apertures in the housing inner layer when in register with the third and fourth (e.g. front) apertures to thereby hold the sliding container in the open configuration and/or to prevent the sliding container from being completely removed from the housing. Preferably the third and fourth apertures are located towards the front of the housing. It will be appreciated that the front of the housing is the region of the housing located toward the open end of the housing. The third and fourth apertures may both allow for the sliding container to be held in the open configuration and prevent complete removal of the sliding container and its contents from the housing.

In another embodiment of the invention the housing may additionally comprises third and fourth (e.g. front) means for applying pressure (e.g. pressing tabs) in register with the third and fourth (e.g. front) apertures (e.g. holes) such that when the sliding container is in the open configuration the user may compress the third and fourth (e.g. front) means for applying pressure (e.g. pressing tabs) such that pressure applied in register with the third and fourth (e.g. front) apertures (e.g. holes) is exerted on the first and second (e.g. substantially wing shaped) engagement means (e.g. tabs) to thereby disengage the first and second (e.g. substantially wing shaped) engagement means (e.g. tabs) for the third and fourth (e.g. front) apertures (e.g. holes) to allow the sliding container and its contents to be completely removed from the housing.

The carton may further comprise at least one tamper evident feature e.g. a feature that provides an indication that the carton has been tampered with e.g. a feature that provides an indication that someone has tried to access the contents of the carton. This feature may be, for example, a tape, a label or a tamper proof seal as set out below.

Preferably the carton comprises a closure flap (e.g. tuck in flap) which covers the open end of the housing when in the closed configuration. Preferably the housing further comprises a seal or lock which locks the closure flap (e.g. tuck in flap) across the open end of the housing when in the closed configuration. Preferable the seal or lock is a tamper proof seal (e.g. tamper evident seal), the tamper proof seal (e.g. tamper evident seal) comprising a perforated portion that ruptures on first opening of the seal to thereby enable removal of the closure flap (e.g. tuck in flap) from the open end. It will be appreciated that a tamper proof seal is a tamper evident seal i.e. a seal that provides an indication that the seal has been tampered with.

Preferably the or each (e.g. substantially wing shaped) engagement means (e.g. tab) is biased outwardly from the side of the sliding container. This enhances engagement of the or a (e.g. substantially wing shaped) engagement means (e.g. tab) with the or a aperture of the inner layer of the housing. Preferably the or each engagement means is substantially wing shaped such that the or each engagement means comprises a first edge orientated substantially at a right angle to the direction of travel of the sliding container and a second edge with an orientation inclined to the direction of travel of the sliding container, wherein the first edge is located towards the open (e.g. front) end of the housing and the second edge is located towards the closed (e.g. rear) end of the housing such that; the first edge of the or each engagement means engages with an aperture in the housing inner layer when in register therewith to thereby hold the sliding container in the closed configuration and/or open configuration; and the second edge of the or each engagement means contacts the edge of a third or fourth (e.g. front) aperture (e.g. hole) in the housing inner layer in such a way to enable the engagement means to slide past the edge of the aperture in moving from the open configuration to the closed configuration.

The applicants have found that the use of substantially wing shaped engagement means provides an effective means for ensuring that the sliding container is effectively held in position when in the closed and open configurations as well as enabling the movement of the sliding container from the open to closed configuration, allowing for the carton to be closed and reused.

Preferably the housing and sliding container are formed from the same material. Preferably the housing outer layer and inner layer are formed from the same continuous sheet of material. Preferably, the housing outer layer and inner layer are connected are so cannot be separated. The material used for a carton according to the present invention may be for example, card, paper board, plastic, polymeric material for example polypropylene, polyethylene terephthalate, or polyvinyl chloride, laminated board and the like. A laminated board may for example comprise a card or paper board substrate and a layer of a polymer such as polyethylene or polyethylene terephthalate attached to the substrate. Laminated board may help to prevent the carton from tearing, so assisting with the child resistant properties of the carton. Preferably the housing and/or sliding container are made from an anti-tear material such as an anti-tear laminate, for example valeron anti-tear laminate.

The material used for a carton according to the present invention may comprise a transparent material, for example a transparent polymer, for example transparent polyethylene terephthalate. Forming the or a portion of the housing from a sheet of transparent material means the sliding container may be visible through the housing portion when the carton is closed. This means that information or graphics disposed on the on the sliding container may be visible when the carton is in the closed configuration. This means that information may not need to be duplicated on the housing and the sliding container.

The carton may comprise a product within the sliding container, for example pharmaceutical product, a smoking product (e.g. smoking article), veterinary product, cleaning product, water treatment product, plant protection product, sharp object, small component, harmful substances and the like. The pharmaceutical product may include one or more tablets, capsules, syringes, liquid formulations and the like. The product may comprise a blister pack comprising a pharmaceutical or other product.

The sliding container may be a box, for example for smoking articles such as tobacco cigarettes or marijuana smoking articles (e.g. joints). The box may be defined by side walls, a front wall, rear wall, a top panel and a bottom panel. The front and/or rear wall may comprise a closure. Providing a closure may act to seal the box to prevent the contents from escaping, while at the same time allowing access by an adult user to the contents within the box. A closure may add an additional level of child resistance to the carton. The closure may comprise a tuck in flap. The closure may further comprise two dust flaps, wherein the tuck in flap engages between the top panel and the dust flaps. The box may comprise a locking element to prevent opening by a child.

The sliding container may be a clamshell container, for example enclosing a blister pack. The clamshell container may be defined by two sections (e.g. halves) joined by a hinge to encase the product inside.

The sliding container may be tamper evident e.g. it may have one or more tamper evident features that indicate when a product from the sliding container has been removed. For example, when the sliding container is a clamshell container, the two sections (e.g. halves) may be joined by a hinge and a perforated portion that ruptures on first opening of the clamshell container to thereby enable removal of the product inside.

The sliding container may be child resistant e.g. it may have one or more child resistant features that prevent a child from accessing the contents of the sliding container when the carton is open. For example, the sliding container may comprise a box with a rim that hinders or prevents a child from accessing the contents of the box when the container is open.

Preferred embodiments of the invention will now be described, by way of example only, with reference to the accompanying drawings, in which.

EXAMPLE 1

Figure 1:
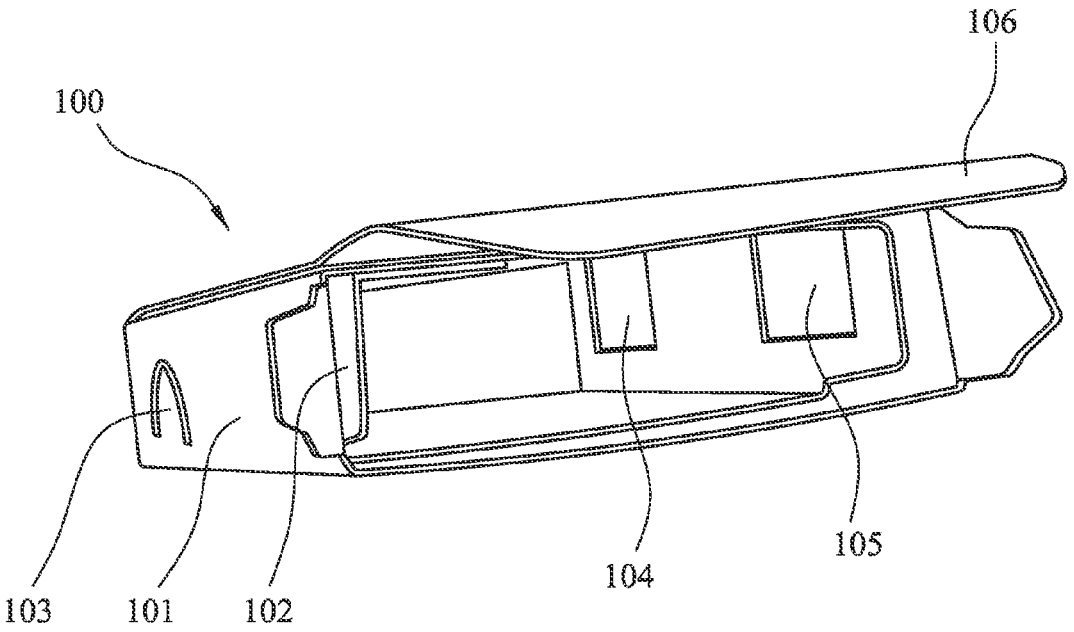
FIG. 1 is a perspective view of a housing according to one embodiment of the present invention.
Figure 2:
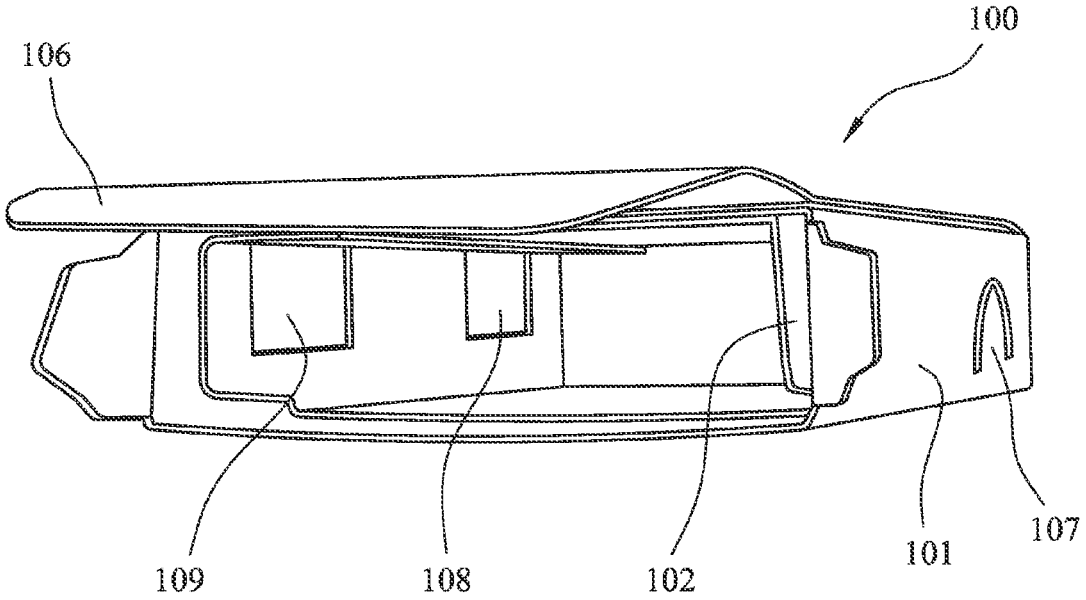
FIG. 2 is a different perspective view of the housing of FIG. 1.
Figure 3:
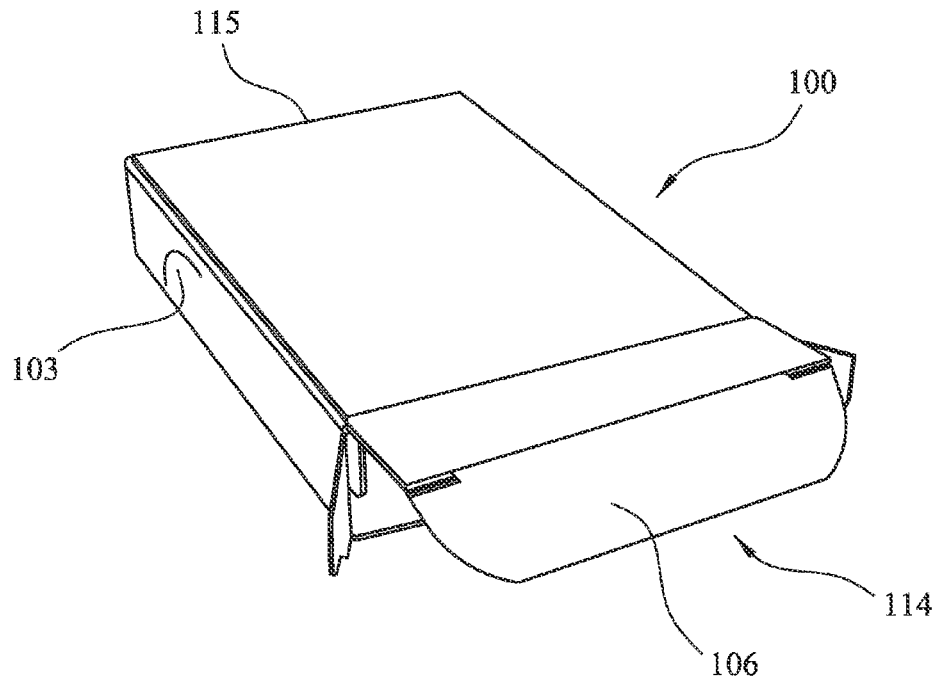
FIG. 3 is different perspective view of the housing of FIGS. 1 and 2.
Figure 5:
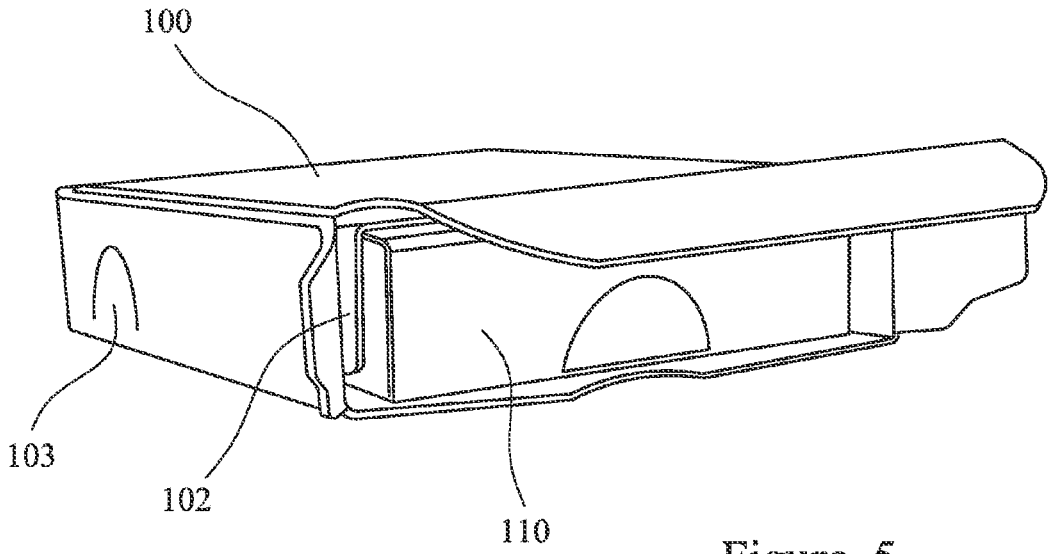
FIG. 5 is a perspective view of a carton according to one embodiment of the present invention comprising the housing of FIGS. 1 to 3 and the sliding container of FIG. 4 when in the closed configuration.
Figure 6:
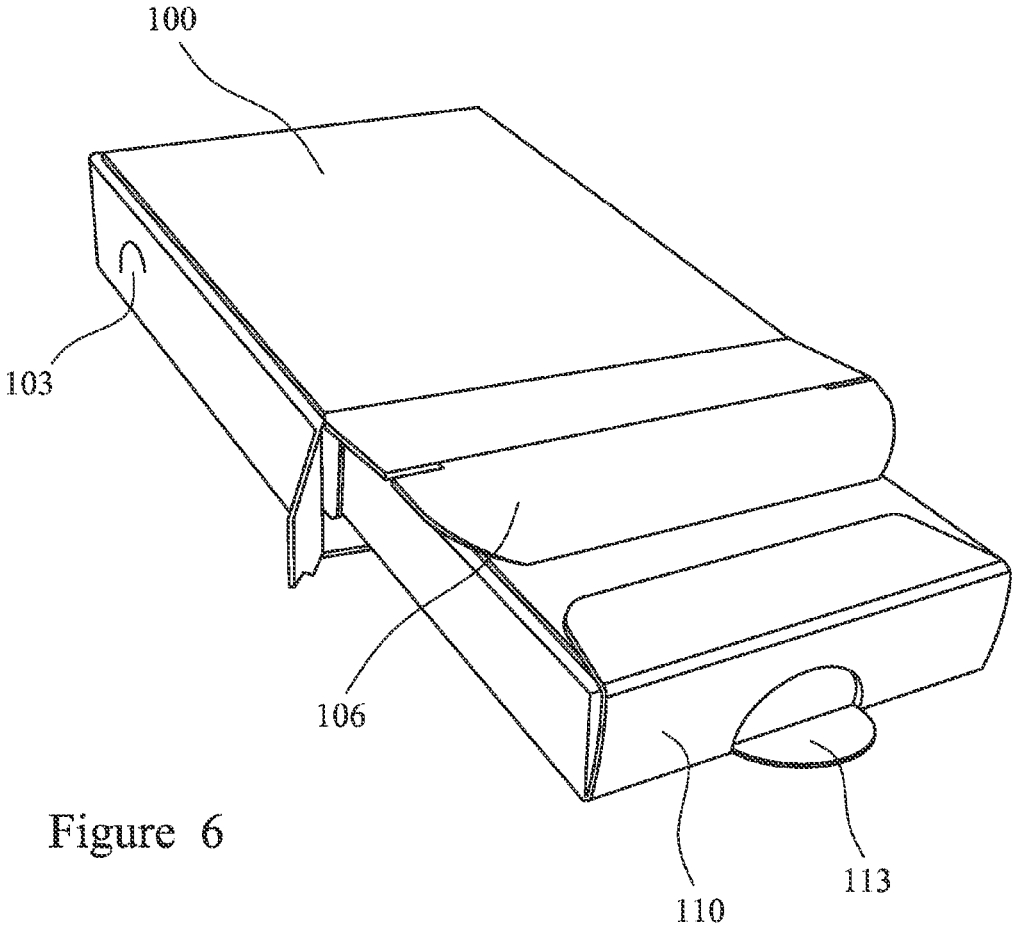
FIG. 6 is a perspective view of the carton of FIG. 5 when in the open configuration.
Figure 7:
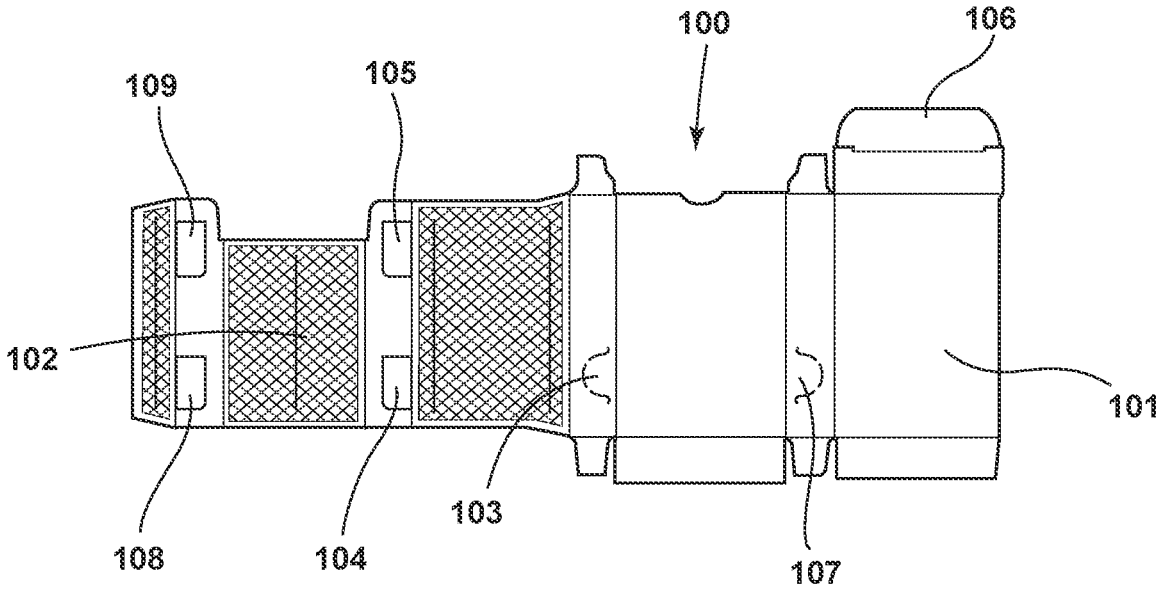
FIG. 7 is the net used to produce the housing of FIGS. 1 to 3.

FIGS. 1 to 6 illustrate a child resistant carton according to one aspect of the present invention. The carton comprises a housing 100 and a sliding container 110. FIGS. 1 to 3 illustrate different views of the housing 100. The housing 100 has an open end 114 positioned at the front end of the housing 100 and a closed end 115 positioned at the rear end of the housing 100. The housing 100 comprises an outer layer 101 and an inner layer 102. A first aperture 104 and second aperture 108 are located on respectively opposite sides of the housing inner layer 102. The first aperture 104 and the second aperture 108 are located towards the closed (i.e. rear) end of the housing. A third aperture 105 and fourth aperture 109 are located on respectively opposite sides of the housing inner layer 102. The third aperture 105 and fourth aperture 109 are located toward the open (i.e. front) end of the housing. The housing 100 also comprises a first means for applying pressure 107 and a second means for applying pressure 103 that are in register with the first aperture 104 and second aperture 108. The housing comprises a closure flap 106 which covers the open end of the housing 100 when in the closed configuration. The housing 100 is formed from a single continuous sheet of valeron anti tear laminate, meaning the outer 101 and inner 102 layers of the housing 100 are formed from the same continuous sheet of material. The use of an anti-tear laminate prevents the carton from being torn open and its contents exposed, forcing the user to open the carton via the mechanism defined by the present invention (outlined below). The housing 100 is formed from a net of valeron. This net is illustrated in FIG. 7. The net of FIG. 7 may be folded along the fold lines indicated via methods well known in the art to produce the housing 100.

Figure 4:
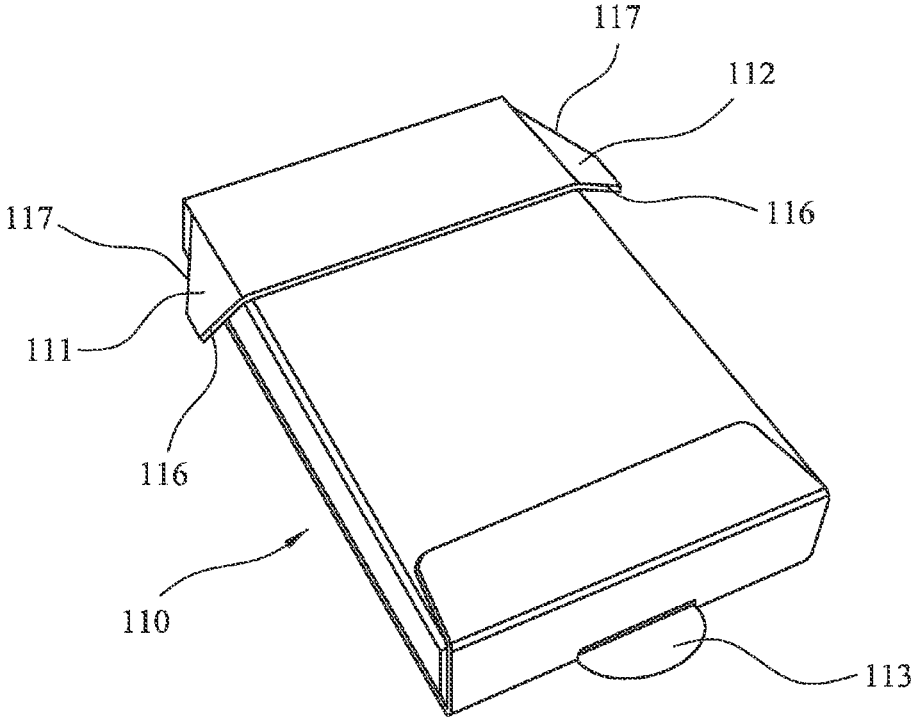
FIG. 4 is a perspective view of a sliding container according to one embodiment of the present invention.
Figure 8:
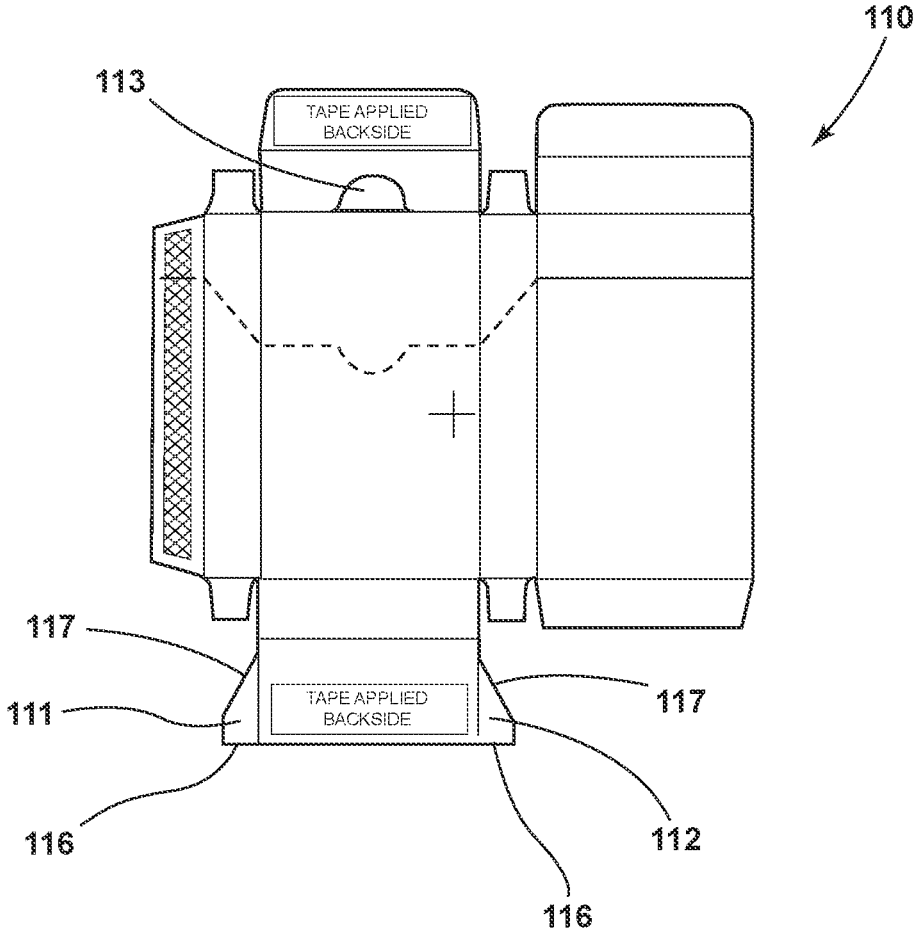
FIG. 8 is the net used to produce the sliding container of FIG. 4.
Figure 9:
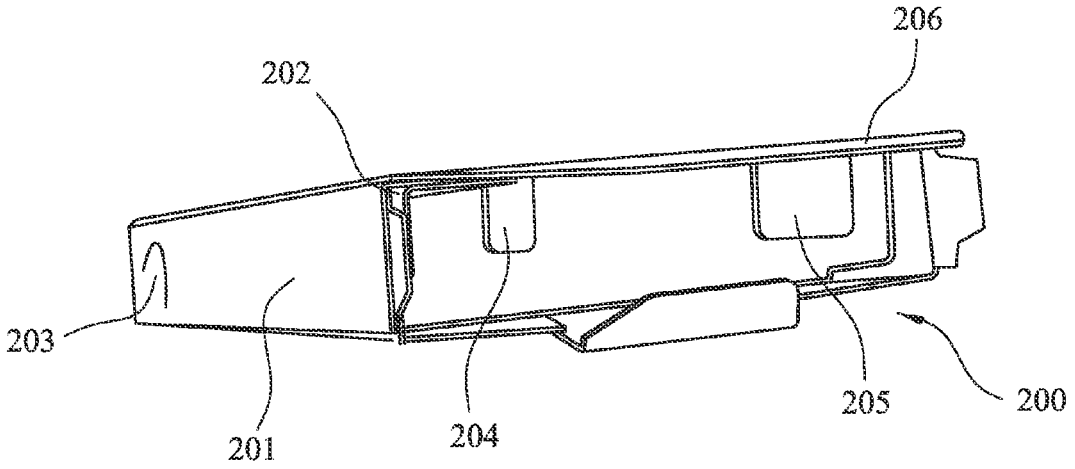
FIG. 9 is a perspective view of a housing according to another embodiment of the present invention.

FIG. 4 illustrates the sliding container 110. The sliding container is dimensioned such that it can be enclosed within the inner layer 102 of housing 100. The sliding container 110 comprises a first engagement means 112 and a second engagement means 111 located on respectively opposite sides of the sliding container 110. The sliding container 110 also comprises a pull tab 113. The sliding container 110 is formed from a single continuous sheet of valeron anti tear laminate. The use of an anti-tear laminate prevents the carton from being torn open and its contents exposed, forcing the user to open the carton via the mechanism defined by the present invention. The sliding container 110 is formed from a net of valeron. This net is illustrated in FIG. 8. The net of FIG. 8 may be folded along the fold lines indicated via methods well known in the art to produce the sliding container 110. The sliding container 110 is a box for marijuana smoking articles (e.g. "joints"). The front wall comprises a closure flap which acts to seal the box, preventing the marijuana smoking articles from escaping, while at the same time allowing access by an adult user to the contents of the box. FIGS. 5 and 6 illustrate the child resistant carton in use. As can be seen from FIGS. 5 and 6 the sliding container 110 can be moved from a closed configuration (FIG. 5) wherein the sliding container 110 is enclosed within the inner layer 102 of the housing 100 to an open configuration (FIG. 6) wherein at least a portion of the sliding container 110 is outside the housing 100. When in the use, the first 112 and second 111 engagement means of the sliding container 110 engage with the first 104 and second 108 apertures of the housing inner layer 102 when in register with the first 104 and second 108 apertures to thereby hold the sliding container 110 in the closed configuration. This is illustrated in FIG. 5.

The outer layer 101 of the housing 100 comprises first 107 and second 103 means for applying pressure in register with the first 104 and second 108 apertures such that pressure applied in register with the first 104 and second 108 apertures is exerted on the first 112 and second 111 engagement means of the sliding container 110 to thereby disengage the first 112 and second 111 engagement means from the first 104 and second 108 apertures of the housing 100. This allows the sliding container 110 to move from the closed configuration to the open configuration.

To open the child resistant carton the user must first open flap 106. The user must then compress both the first 107 and second 103 means for applying pressure while simultaneously pulling the pull tab 113. The distance between the first 107 and second 103 means for applying pressure is around 67 mm. Due to the first 107 and second 103 means for applying pressure being positioned on respectively opposite sides of the carton at a distance of 67 mm apart, a child would not be able to open the carton as they would not have a sufficiently large finger span or hand span to do so. They would also not have the dexterity required to press both means for applying pressure and pull the pull tab at the same time.

When the sliding container 110 is moved from the closed configuration to the open configuration, the first 112 and second 111 engagement means engage with the third 105 and fourth 109 apertures in the housing inner layer 102 when in register with the third 105 and fourth 109 apertures to thereby hold the sliding container 110 in the open configuration and to prevent the sliding container 110 from being completely removed from the housing 100.

As can be seen from FIG. 4, the first 112 and second 111 engagement means of the sliding container 110 are biased outwardly from the side of the sliding container 110. This enhances engagement of the or a first 112 and second 111 engagement means with the apertures of the housing 100. The first 112 and second 111 engagement means are substantially wing shaped such that they comprise a first edge 116 orientated substantially at a right angle to the direction of travel of the siding container 110 and a second edge 117 with an orientation inclined to the direction of travel of the sliding container 110. When in use, the first edge 116 of the first 112 and second 111 engagement means engages with an aperture in the housing inner layer 102 when in register therewith to thereby hold the sliding container 110 in the closed configuration and open configuration. When in the open configuration, the second edge 117 of the first 112 and second 111 engage means contacts the edge of the third 105 and fourth 109 aperture in such a way to enable the first 112 and second 111 engagement means to slide past the edges of the apertures when moving from the open configuration to the closed configuration. This use of substantially wing shaped engagement means provides an effective means for ensuring that the sliding container is effectively held in position when in the closed and open configurations as well as enabling the movement of the sliding container from the open to closed configuration, allowing for the carton to be closed and reused.

EXAMPLE 2

Figure 13:
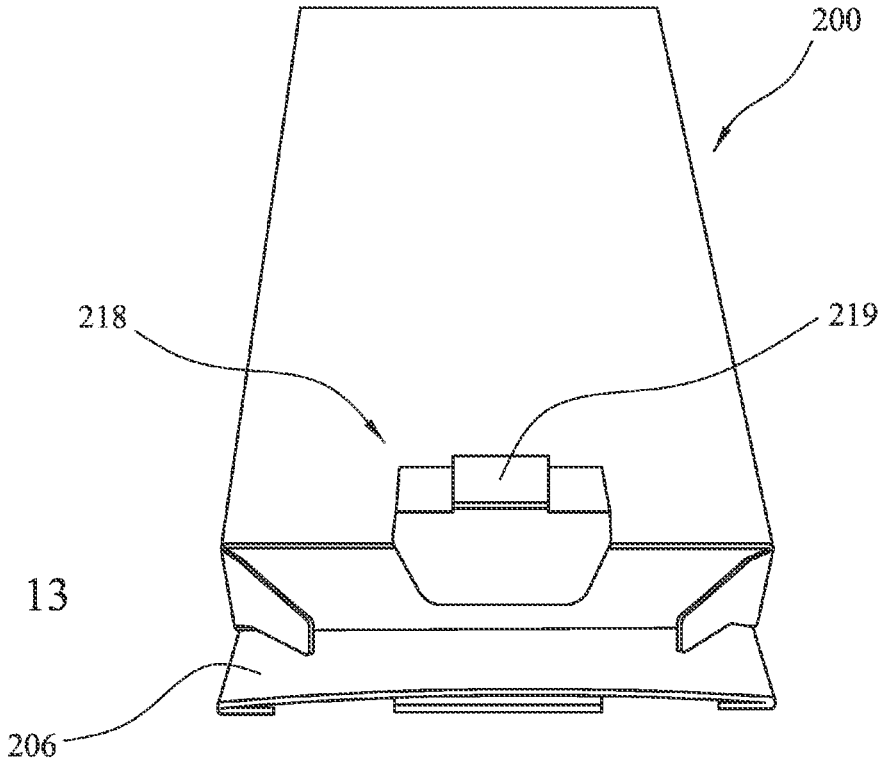
FIG. 13 is a different perspective view of the housing of FIGS. 9. 10, 11 and 12, showing the tamper evident seal after first opening of the seal.

FIGS. 9 to 17 illustrate a child resistant carton according to another aspect of the present invention. The carton comprises a housing 200 and a sliding container 210. FIGS. 9 to 13 illustrate different views of the housing 200. The housing 200 has an open end 214 positioned at the front end of the housing 200 and a closed end 215 positioned at the rear end of the housing 200. The housing 200 comprises an outer layer 201 and an inner layer 202. A first aperture 204 and second aperture 208 are located on respectively opposite sides of the housing inner layer 202. The first aperture 204 and the second aperture 208 are located towards the closed (i.e. rear) end of the housing. A third aperture 205 and fourth aperture 209 are located on respectively opposite sides of the housing inner layer 202. The third aperture 205 and fourth aperture 209 are located toward the open (i.e. front) end of the housing. The housing 200 also comprises a first means for applying pressure 207 and a second means for applying pressure 203 that are in register with the first aperture 204 and second aperture 208. The housing 200 comprises a closure flap 206 which covers the open end of the housing 200 when in the closed configuration. The housing also comprises a tamper proof seal 218 that locks the closure flat 206 across the open end 214 of the housing when in the closed configuration. The tamper proof seal 218 comprises a perforated portion 219 that ruptures on first opening as illustrated in FIG. 13. This enables removal of the closure flap 206 from the open end 214 of the housing 200 as illustrated in FIG. 13.

Figure 18:
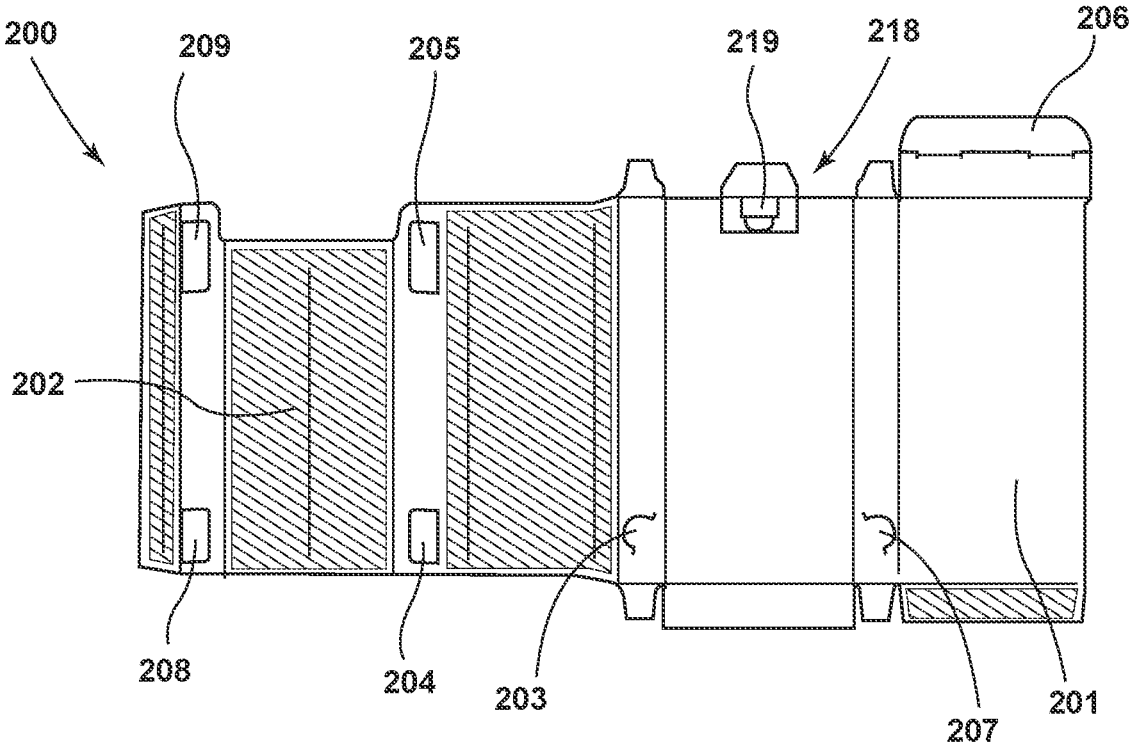
FIG. 18 is the net used to produce the housing of FIGS. 9 to 13.

The housing 200 is formed from a single continuous sheet of valeron anti tear laminate, meaning the outer 201 and inner 202 layers of the housing 200 are formed from the same continuous sheet of material. The use of an anti-tear laminate prevents the carton from being torn open and its contents exposed, forcing the user to open the carton via the mechanism defined by the present invention (outlined below). The housing 200 is formed from a net of valeron. This net is illustrated in FIG. 18. The net of FIG. 18 may be folded along the fold lines indicated via methods well known in the art to produce the housing 200.

Figure 10:
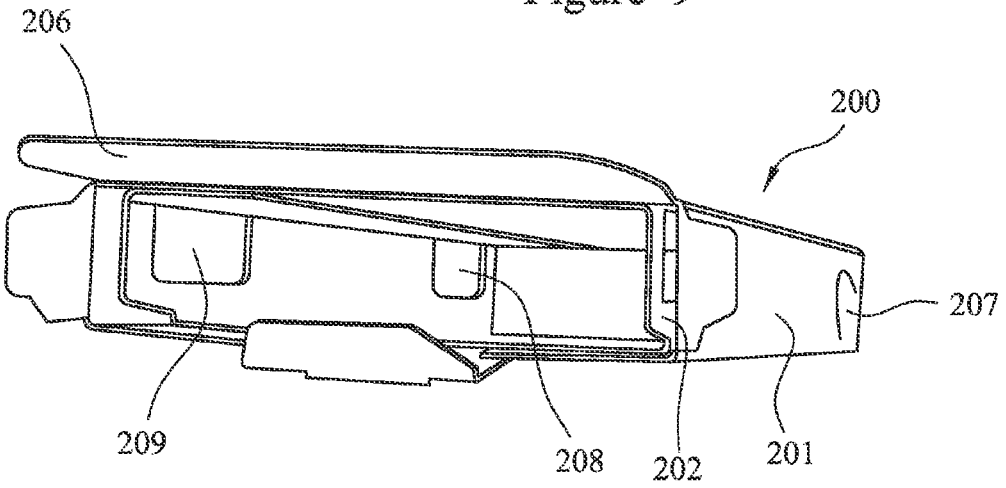
FIG. 10 is a different perspective view of the housing of FIG. 9.
Figure 11:
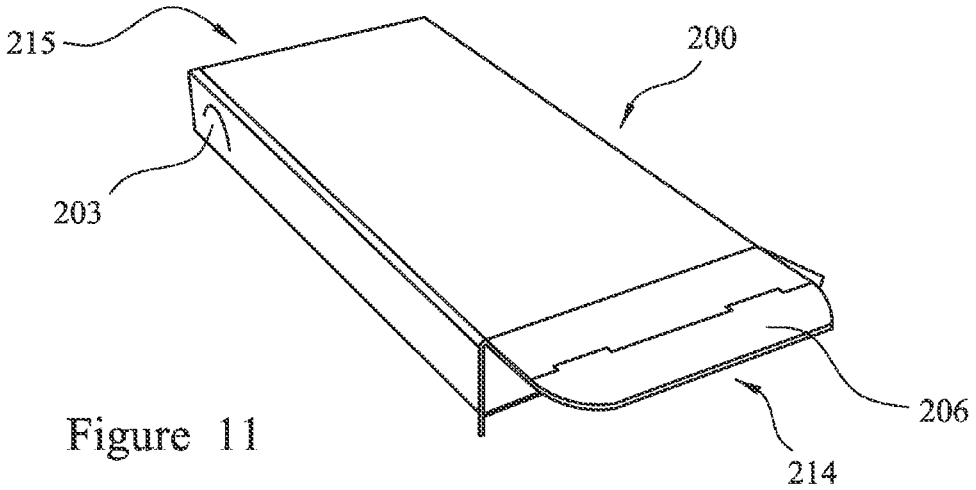
FIG. 11 is a different perspective view of the housing of FIGS. 9 and 10.
Figure 12:
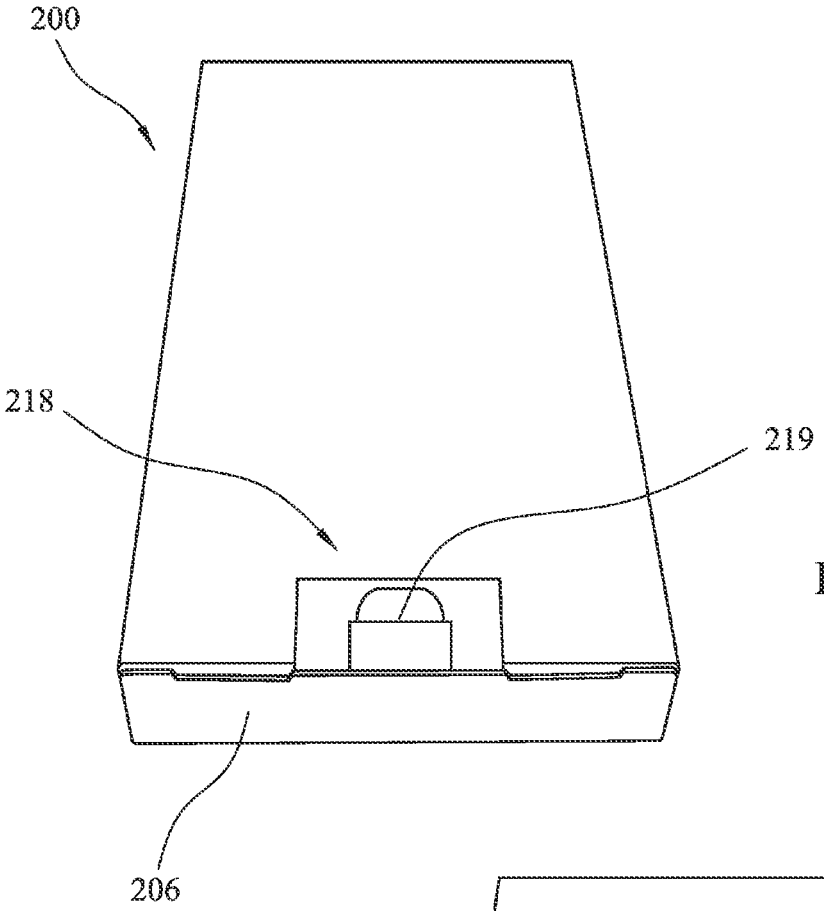
FIG. 12 is a different perspective view of the housing of FIGS. 9, 10 and 11, showing the tamper evident seal before first opening of the seal.
Figure 14:
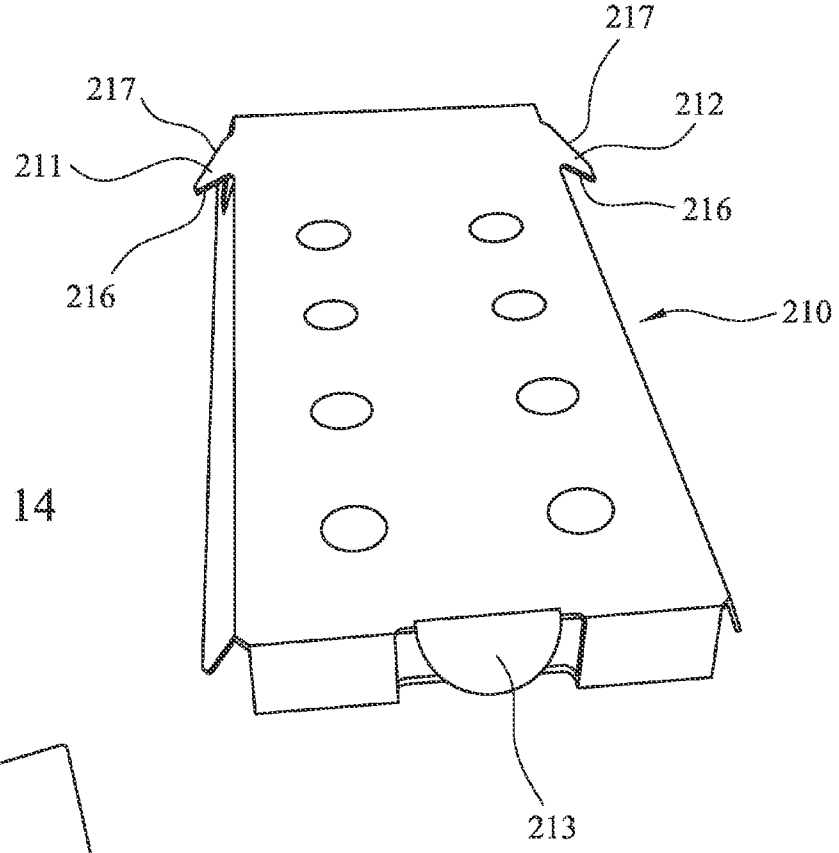
FIG. 14 is a perspective view of a sliding container according to another embodiment of the present invention.
Figure 15:
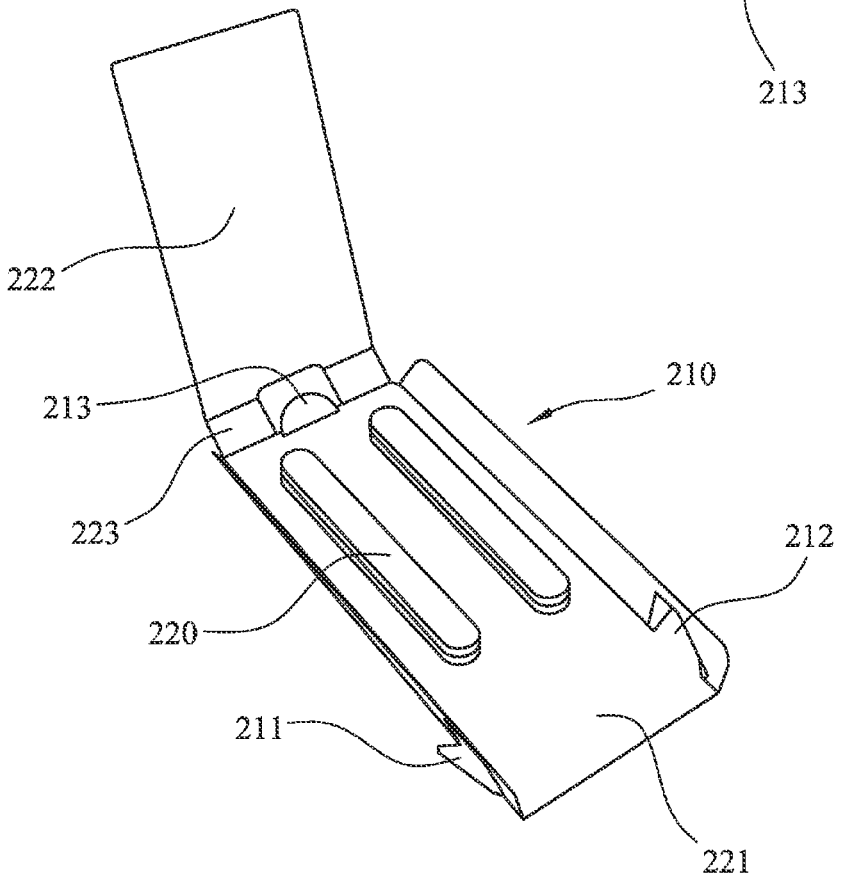
FIG. 15 is a different perspective view of the sliding container of FIG. 14.
Figure 19:
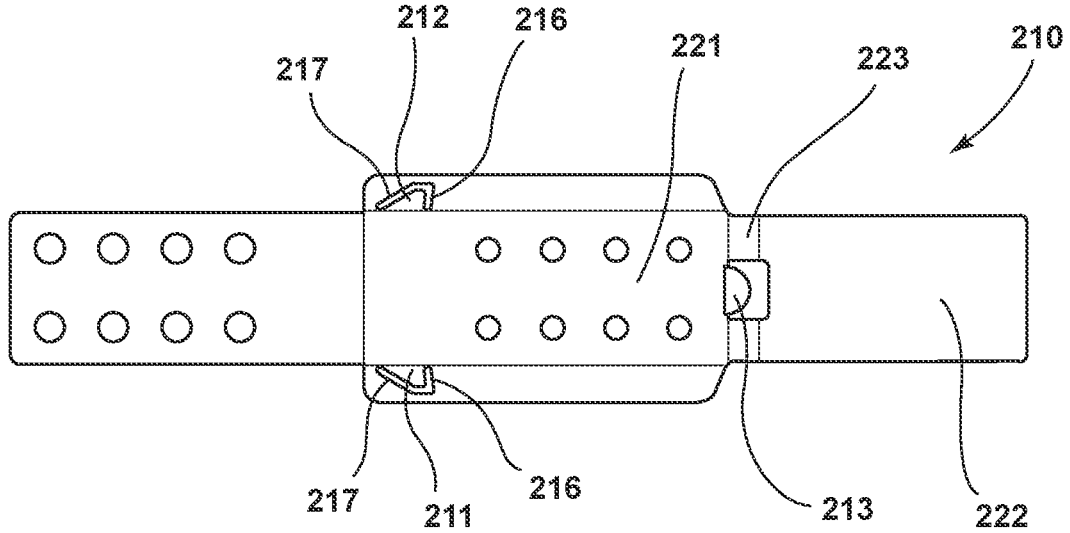
FIG. 19 is the net used to produce the sliding container of FIGS. 14 and 15.

FIGS. 14 and 15 illustrate the sliding container 210. The sliding container is dimensioned such that it can be enclosed within the inner layer 202 of housing 200. The sliding container 210 comprises a first engagement means 212 and a second engagement means 211 located on respectively opposite sides of the sliding container 210. The sliding container 210 also comprises a pull tab 213. The sliding container 210 is formed from a single continuous sheet of valeron anti tear laminate. The use of an anti-tear laminate prevents the carton from being torn open and its contents exposed, forcing the user to open the carton via the mechanism defined by the present invention. The sliding container 210 is formed from a net of valeron. This net is illustrated in FIG. 10. The net of FIG. 19 may be folded along the fold lines indicated via methods well known in the art to produce the sliding container 210. The sliding container 210 is a clamshell container enclosing a blaster pack 220 (see FIG. 15 showing the open clamshell with a mock up blister pack 220 inside). The clamshell container is defined by a first halve 221 and a second halve 222 joined by a hinge 223. The clamshell container is capable of encasing the product inside (e.g. the blister pack 220) as illustrated in FIG. 14.

Figure 16:
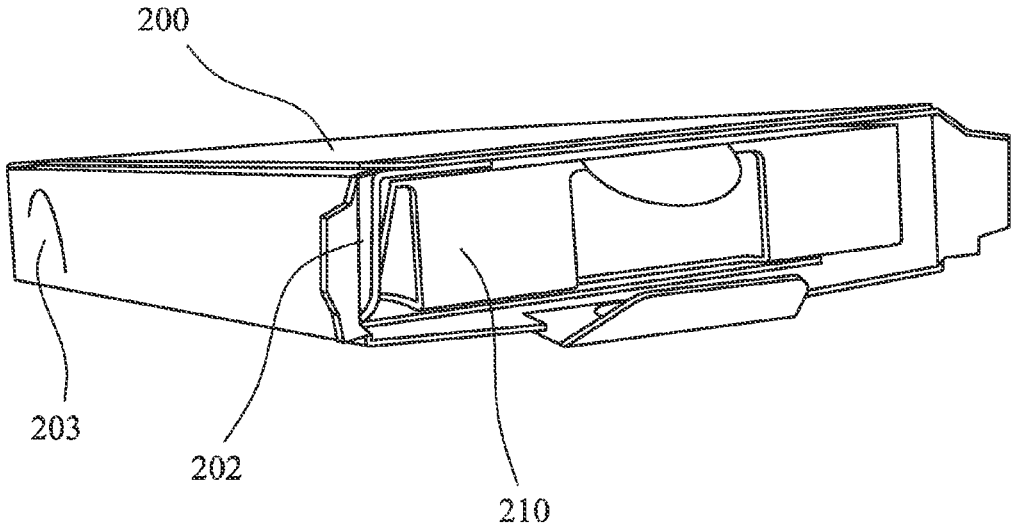
FIG. 16 is a perspective view of a carton according to another embodiment of the present invention comprising the housing of FIGS. 9 to 13 and the sliding container of FIGS. 14 and 15 when in the closed configuration.
Figure 17:
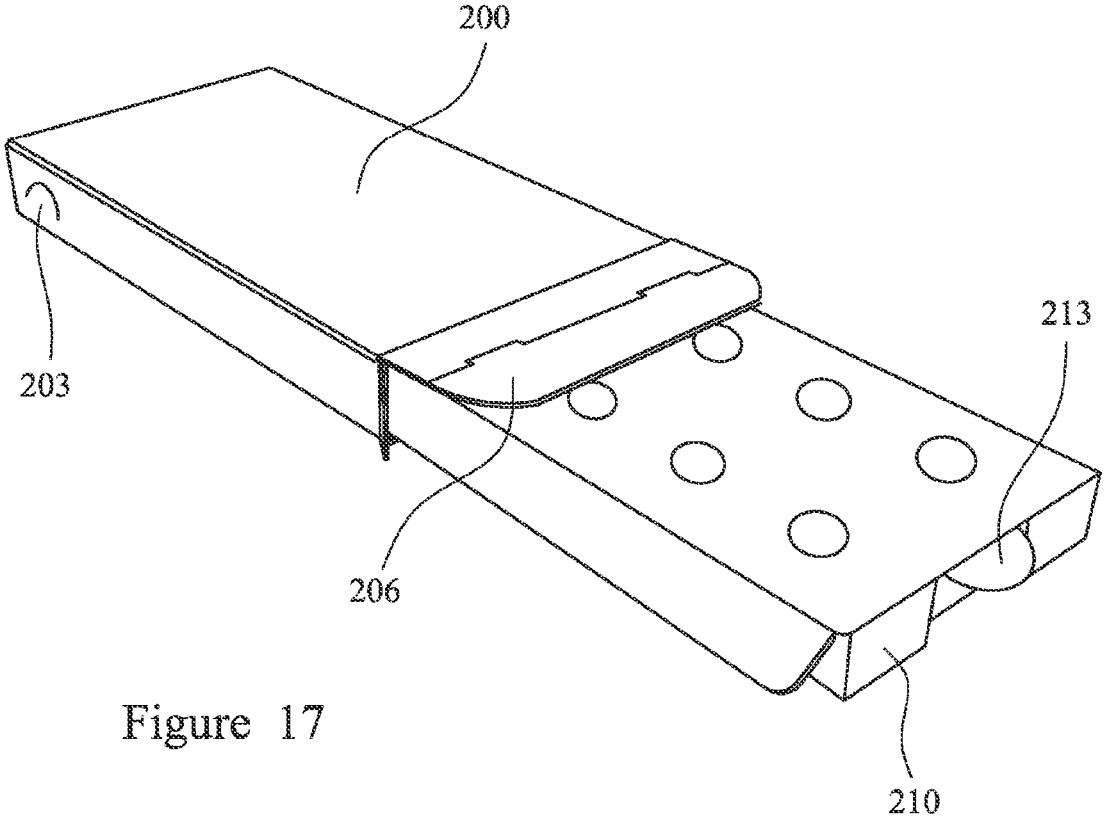
FIG. 17 is a perspective view of the carton of FIG. 16 when in the open configuration.

FIGS. 16 and 17 illustrate the child resistant carton in use. As can be seen from FIGS. 16 and 17 the sliding container 210 can be moved from a closed configuration (FIG. 16) wherein the sliding container 210 is enclosed within the inner layer 202 of the housing 200 to an open configuration (FIG. 17) wherein at least a portion of the sliding container 210 is outside the housing 200. When in the use, the first 212 and second 211 engagement means of the sliding container 210 engage with the first 204 and second 208 apertures of the housing inner layer 202 when in register with the first 204 and second 208 apertures to thereby hold the sliding container 210 in the closed configuration. This is illustrated in FIG. 16.

The outer layer 201 of the housing 200 comprises first 207 and second 203 means for applying pressure in register with the first 204 and second 208 apertures such that pressure applied in register with the first 204 and second 208 apertures is exerted on the first 212 and second 211 engagement means of the sliding container 210 to thereby disengage the first 212 and second 211 engagement means from the first 204 and second 208 apertures of the housing 200. This allows the sliding container 210 to move from the closed configuration to the open configuration.

To open the child resistant carton the user must first open flap 206. The user must then compress both the first 207 and second 203 means for applying pressure while simultaneously pulling the pull tab 213. The distance between the first 207 and second 203 means for applying pressure is around 79 mm. Due to the first 207 and second 203 means for applying pressure being positioned on respectively opposite sides of the carton at a distance of 79 mm apart, a child would not be able to open the carton as they would not have a sufficiently large finger span or hand span to do so. They would also not have the dexterity required to press both means for applying pressure and pull the pull tab at the same time.

When the sliding container 210 is moved from the closed configuration to the open configuration, the first 212 and second 211 engagement means engage with the third 205 and fourth 209 apertures in the housing inner layer 202 when in register with the third 205 and fourth 209 apertures to thereby hold the sliding container 210 in the open configuration and to prevent the sliding container 210 from being completely removed from the housing 200.

As can be seen from FIGS. 14 and 15, the first 212 and second 211 engagement means of the sliding container 210 are biased outwardly from the side of the sliding container 210. This enhances engagement of the or a first 212 and second 211 engagement means with the apertures of the housing 200. The first 212 and second 211 engagement means are substantially wing shaped such that they comprise a first edge 216 orientated substantially at a right angle to the direction of travel of the siding container 210 and a second edge 217 with an orientation inclined to the direction of travel of the sliding container 210. When in use, the first edge 216 of the first 212 and second 211 engagement means engages with an aperture in the housing inner layer 202 when in register therewith to thereby hold the sliding container 210 in the closed configuration and open configuration. When in the open configuration, the second edge 217 of the first 212 and second 211 engage means contacts the edge of the third 205 and fourth 209 aperture in such a way to enable the first 212 and second 211 engagement means to slide past the edges of the apertures when moving from the open configuration to the closed configuration. This use of substantially wing shaped engagement means provides an effective means for ensuring that the sliding container is effectively held in position when in the closed and open configurations as well as enabling the movement of the sliding container from the open to closed configuration, allowing for the carton to be closed and reused.

In these examples the first (112 & 212) and second (111 & 211) engagement means are in the form of tabs and the first (107 & 207) and second (103 & 203) means for applying pressure are in the form of pressing tabs.

The invention claimed is:

1. A carton comprising:

a housing comprising an outer layer and an inner layer; and a sliding container dimensioned such that the sliding container may be enclosed within the inner layer of the housing;

wherein the sliding container comprises a pull tab and wherein the pull tab is located on a front side of the sliding container;

wherein the sliding container can be moved from a closed configuration wherein the sliding container is enclosed within the inner layer of the housing to an open configuration wherein at least a portion of the sliding container is outside the housing;

wherein the sliding container comprises at least one engagement means which engages with at least one aperture in the inner layer of the housing when in register with the at least one aperture to thereby hold the sliding container in the closed configuration;

wherein the outer layer of the housing comprises at least one means for applying pressure in register with the at least one aperture of the inner layer, such that pressure applied in register with the at least one aperture of the inner layer is exerted on the at least one engagement means to thereby disengage the at least one engagement means from the at least one aperture to allow the sliding container to move from the closed configuration to the open configuration;

wherein the at least one engagement means comprises first and second engagement means and the at least one aperture comprises first and second apertures, with the first and second engagement means located on opposite sides of the sliding container which engage with the first and second apertures on opposite sides of the inner layer of the housing when in register with the first and second apertures;

wherein the at least one means for applying pressure comprises first and second means for applying pressure, with the outer layer of the housing comprising the first and second means for applying pressure in register with the first and second engagement means to thereby disengage the first and second engagement means from the first and second apertures to allow the sliding container to move from the closed configuration to the open configuration; and wherein the first and second means for applying pressure are located on opposite sides of the housing at a separation distance of between 50 mm and 150 mm.

2. A carton according to claim 1 wherein the inner layer of the housing comprises third and fourth apertures located on opposite sides of the inner layer of the housing such that the first and second engagement means engage with the first and second apertures in the inner layer of the housing when in register with the first and second apertures to thereby hold the sliding container in the closed configuration; and wherein, when the sliding container is moved from the closed configuration to the open configuration, the first and second engagement means engage with the third and fourth apertures in the inner layer of the housing when in register with the third and fourth apertures to thereby hold the sliding container in the open configuration, and/or to prevent the sliding container from being completely removed from the housing.

3. A carton according to claim 1 wherein the at least one means for applying pressure is a pressing tab.

4. A carton according to claim 1 wherein the at least one engagement means is a tab.

5. A carton according to claim 1 wherein the housing comprises an open end and a closed end, and wherein the sliding container extends from the open end when in the open configuration.

6. A carton according to claim 5 further comprising a closure flap which covers the open end when in the closed configuration.

7. A carton according to claim 6 wherein the housing further comprises a seal or lock which locks the closure flap across the open end of the housing when in the closed configuration.

8. A carton according to claim 7 wherein the seal or lock comprises the seal, the seal is a tamper proof seal, the tamper proof seal comprising a perforated portion that ruptures on first opening of the seal to thereby enable removal of the closure flap from the open end.

9. A carton according to claim 1 wherein the at least one engagement means is biased outwardly from a side of the sliding container.

10. A carton according to claim 5 wherein the at least one engagement means is substantially wing shaped such that the at least one engagement means comprises a first edge orientated substantially at a right angle to a direction of travel of the sliding container and a second edge with an orientation inclined to the direction of travel of the sliding container;

wherein the first edge is located towards the open end of the housing and the second edge is located towards the closed end of the housing such that:

the first edge of the at least one engagement means engages with the at least one aperture in the inner layer of the housing when in register therewith to thereby hold the sliding container in the closed configuration and/or the open configuration; and the second edge of the at least one engagement means contacts an edge of a third or fourth aperture in the inner layer of the housing in such a way to enable the at least one engagement means to slide past the edge of the third or fourth aperture in moving from the open configuration to the closed configuration.

11. A carton according to claim 1 wherein the housing and the sliding container are formed from the same material.

12. A carton according to claim 1 wherein the housing and/or the sliding container are made from an anti-tear laminate.

13. A carton according to claim 1 wherein the outer layer and the inner layer of the housing are formed from the same continuous sheet of material.

14. A carton according to claim 1 wherein the sliding container is a box.

15. A carton according to claim 1 wherein the sliding container is a clamshell container or a clamshell container enclosing a blister pack.

16. A carton according to claim 1 wherein the sliding container encloses a pharmaceutical product.

* * * * *